252-95 AU 157 EX

1/27/87 XR 4,639,326

United States Patent [19]

Czempik et al.

[11] Patent Number: 4,639,326

[45] Date of Patent: Jan. 27, 1987

[54] PROCESS FOR THE PREPARATION OF A POWDER DETERGENT COMPOSITION OF HIGH BULK DENSITY

[75] Inventors: Klaus Czempik, Verden; Gerd Stremmel, Brühl, both of Fed. Rep. of Germany

[73] Assignee: Lever Brothers Company, New York, N.Y.

[21] Appl. No.: 752,344

[22] Filed: Jul. 3, 1985

[30] Foreign Application Priority Data

Jul. 6, 1984 [DE] Fed. Rep. of Germany ..... 3424987

[51] Int. Cl.[4] ..... C11D 1/83; C11D 3/075; C11D 11/00; C11D 11/02

[52] U.S. Cl. ..... 252/91; 252/95; 252/99; 252/135; 252/140; 252/174; 252/174.13; 252/174.21; 252/174.25; 252/540; 252/559; 427/220

[58] Field of Search ..... 252/90, 91, 95, 99, 252/140, 174, 174.13, 174.21, 174.25, 179, 540, 559; 427/220

[56] References Cited

U.S. PATENT DOCUMENTS

| | | | |
|---|---|---|---|
| 3,538,004 | 11/1970 | Gabler | 252/99 |
| 3,700,600 | 10/1972 | Nagel | 252/99 |
| 3,769,222 | 10/1973 | Yurko | 252/559 |
| 3,886,098 | 5/1975 | DiSalvo | 252/540 |
| 3,920,586 | 11/1975 | Bonaparte | 252/531 |
| 4,136,051 | 1/1979 | Saran | 252/91 |
| 4,288,342 | 9/1981 | Wagner | 252/140 |
| 4,311,607 | 1/1982 | Kaeser | 252/140 |
| 4,330,424 | 5/1982 | Joshi | 252/135 |
| 4,368,134 | 1/1983 | Kaeser | 252/140 |
| 4,406,808 | 9/1983 | Gangwisch | 252/91 |

*Primary Examiner*—Dennis L. Albrecht

*Attorney, Agent, or Firm*—Milton L. Honig; James J. Farrell

[57] ABSTRACT

The invention relates to a process for the preparation of a nonionic surfactant-containing powder detergent composition wherein a spray-dried sodium sulphate-free base powder containing a portion of the nonionic surfactant is obtained and the remaining portion of the nonionic surfactant is in part sprayed onto the base powder and in part added subsequently in a form obtained by granulation with a carrier containing a mixture of zeolite and alkali metal perborate monhydrate and wherein the other detergent components are added subsequently to the base powder. A detergent composition prepared in this manner has a high bulk density despite its high AD content.

5 Claims, No Drawings

PROCESS FOR THE PREPARATION OF A POWDER DETERGENT COMPOSITION OF HIGH BULK DENSITY

The invention relates to a process for the preparation of a powder detergent composition of high bulk density and more particularly to a process for the preparation of a detergent composition of the aforesaid kind having a high AD content (AD=active detergent).

Powdered detergent compositions are usually manufactured in a spray-drying process. In such a process an aqueous slurry of all the spray-dryable detergent components is spray-dried and to the powder thus obtained, often referred to as the base powder, there are subsequently added other desired detergent components that are not spray-dryable such as enzymes, bleaches and the like. These other components are often added to the base powder in a granulated form, or if liquid, they are sprayed onto the base powder or the finished powder mixture.

The powder detergent compositions thereby obtained generally have a bulk density of less than 0.60 kg/l. The bulk density is essentially dependent upon the bulk densities of the base powder and additives and is chiefly determined by the composition of the base powder. If for example the AD content of the slurry is increased, the base powder obtained will have a low bulk density, as will the finished powder.

Accordingly it is the aim of the invention to prepare by the afore-described process a finished powder having a high AD content in base powder form and a high bulk density in the finished form as well as all the other benefits of spray-dried detergent powders such as solubility, wetting and sinking properties.

It has been surprisingly found that this aim can be achieved by preparing a base powder that is substantially free of sodium sulphate and in a subsequent step introducing the remaining detergent components by means of spraying and incorporation in granulate form.

From German Auslegeschrift No. 1,951,556 there is known a process for the preparation of powder detergents wherein a base powder is obtained by spray-drying, the remaining detergent components being subsequently added to the base powder. For example if nonionics are required in the finished detergent, it is advantageous if only a portion of the nonionic material is incorporated in the base powder by spray-drying, the remaining portion being subsequently sprayed onto the base powder and/or added thereto in granulate form together with the other components of the detergent composition. However, this art proposes improving the powder properties of the base powder by incorporating non-surfactant non-hygroscopic substances such as for example sodium sulphate. The non-surfactant components can constitute up to 20% of the base powder.

It has now been surprisingly found in accordance with the invention that when sodium sulphate is largely omitted there results a base powder which has a high bulk density despite its high AD content. Furthermore, it has been found that if a portion of the remaining nonionic surfactant is sprayed onto the base powder and the rest added in a granulated form obtained with the aid of a carrier containing zeolite and perborate monohydrate, a high bulk density finished powder is obtained.

Accordingly therefore the present invention relates to a process for the preparation of a nonionic surfactant-containing powder detergent composition of high AD content and high bulk density, wherein a spray-dried base powder containing a portion of the nonionic surfactant is obtained and the remaining portion of the nonionic surfactant is in part sprayed onto the base powder and in part added subsequently in a form obtained by granulation with a carrier and wherein the other detergent components are added subsequently to the base powder, which process is characterized in that the base powder is essentially free of sodium sulphate and the carrier for the nonionic surfactant chiefly contains a mixture of zeolite and perborate monohydrate.

It is also within the scope of the invention to spray AD combinations of nonionic and anionic surfactants onto the base powder and the carrier mixture.

Useful nonionic surfactants can be chosen from nonionics based on natural or synthetic fatty alcohols or oxo alcohols, fatty acid amides and fatty acid alkylolamides.

The hydrophobic moiety of the aforesaid nonionic surfactants will generally have a chain length of $C_{10}$–$C_{20}$ and a degree of ethoxylation of from 5 to 20 mol EO (=ethylene oxide).

Preferably, $C_{12}$–$C_{15}$ alcohols having a degree of ethoxylation of from 5 to 12 mol EO are used.

The anionics can be selected from conventional anionic surfactants such as alkylbenzene sulphonates, alkyl sulphates, alkyl sulphonates, alkyl ether sulphates and the like. Preferably, linear alkylbenzene sulphonates, alkyl sulphonates and/or alkyl sulphates or mixtures thereof are used.

The invention will now be described in greater detail.

The detergent composition contains one or more active detergent materials which can be of any known type. It contains at least one nonionic surfactant but can additionally contain other surfactants such as anionic, cationic, and zwitterionic surfactants and mixtures thereof. Preferably the detergent contains a mixture of nonionic and anionic surfactants.

Generally, the content of nonionic surfactant in the finished detergent powder is from 5 to 15% by weight and the content of anionic surfactant from nil to 12% by weight.

Only a portion of the nonionic surfactant can be introduced into the base powder by spray-drying. This portion can be more than one-half of the total quantity of the nonionic surfactant present in the finished powder, but generally the nonionic content of the base powder will not be more than one-half of the total quantity of nonionic material in the finished powder. The remaining portion of nonionic surfactant is in part sprayed onto the base powder; generally, not more than one-half of the remaining portion of nonionic surfactant is sprayed onto the base powder. The other portion is added to the base powder in granulated form with aid of a carrier.

The other surfactants can be completely incorporated in the base powder by spray-drying, or alternatively a portion thereof together with a portion of nonionic surfactant can be sprayed onto the base powder or onto the carrier mixture of the granulate. This procedure is advantageous if a finished powder with a high anionic AD content is required.

The base powder further contains known spray-dryable detergent components such as builder salts, silicates, brighteners, soil-suspending agents and the like. In this connection it is useful if the powder contains a certain amount, for example a few percent, of a zeolite to facilitate incorporation of the sprayed-on nonionic or nonionic/anionic material.

As was stated hereinabove, a portion of the nonionic surfactant is added to the base powder in a form obtained by granulation with a carrier. The carrier contains a mixture of zeolite and perborate monohydrate. The zeolite can be any suitable sodium aluminium silicate that is known for use as a detergency builder in detergent compositions. A useful example thereof is the zeolite HAB A 40 available commercially from Degussa. Sodium perborate monohydrate is especially useful as the perborate monohydrate. The carrier mixture is granulated with the nonionic surfactant or with the nonionic/anionic surfactant mixture; other components such as sodium tripolyphosphate or sodium sulphate can be added to the granulate. The remaining detergent components are subsequently added to the base powder in an appropriate manner, for example in the form of a granulate or powder or liquid. Typical examples of such additives include granulated bleach activators, bleaches, sequestering agents, enzymes, foam depressants, perfumes and the like.

The detergent composition can additionally contain other usual components that are desired for particular reasons in a detergent composition.

The invention will now be described in further detail in the Examples following hereinbelow.

EXAMPLE 1

The following base powder was prepared by conventionally spray-drying an aqueous slurry comprising:

| | Parts by weight |
|---|---|
| Sodium alkylbenzene sulphonate | 3.00 |
| $C_{12}$–$C_{15}$ oxo alcohol, condensed with 12 mole EO | 5.85 |
| Nonylphenol, condensed with 5/9 mole EO (ex zeolite) | 0.15 |
| Sodium tripolyphosphate | 25.00 |
| Sodium silicate, neutral | 5.30 |
| Zeolite, HAB A 40 | 5.00 |
| Sodium CMC | 1.06 |
| EDTA | 0.27 |
| Brightener | 0.187 |
| Salts | 0.8 |
| Water | 8.653 |
| | 58.57 |

The bulk density of this base powder was less than 0.60 kg/l.

The base powder was sprayed with 4 parts by weight of a $C_{12}$–$C_{15}$ oxo alcohol condensed with 7 moles of ethylene oxide and the bulk density of the product thus obtained was 0.62 kg/l.

A granulate containing the following components was prepared in a granulator:

| | Parts by weight |
|---|---|
| Sodium perborate monohydrate | 8.50 |
| Sodium tripolyphosphate | 7.00 |
| Sodium sulphate | 2.24 |
| Zeolite, HAB 40 (80%) | 3.00 |
| $C_{12}$–$C_{15}$ oxo alcohol, condensed with 7 mol EO | 4.00 |
| Water | 1.00 |

This granulate had a bulk density of 0.96 kg/l.

The base powder and the granulate were mixed together and the remaining detergent components were added, namely 8.5 parts TAED granulate (65%), enzyme granules, perfume and a calcium salt of ethylenediaminetetramethylenephosphonic acid. The finished powder had a bulk density of 0.68 kg/l. and an AD content of 14 parts by weight of nonionic surfactant and 3 parts by weight anionic surfactant.

EXAMPLE 2

The following detergent was prepared in a similar manner as in Example 1:

| Base powder | Parts by weight |
|---|---|
| Sodium alkylbenzene sulphonate | 5.00 |
| $C_{12}$–$C_{15}$ oxo alcohol, condensed with 7 mol EO | 4.00 |
| Nonylphenol, condensed with 5/9 mol EO | 0.15 |
| Sodium CMC | 1.06 |
| Acrylic acid/maleic anhydride copolymer | 2.00 |
| Sodium tripolyphosphate | 25.00 |
| Zeolite | 5.00 |
| Sodium silicate ($Na_2O$:$SiO_2$ = 1:3.3) | 5.30 |
| EDTA | 0.265 |
| Brightener | 0.527 |
| Salts | 1.106 |
| Water | 8.50 |

The bulk density was 0.60 kg/l.

The base powder was sprayed with a mixture of 4 parts by weight of a $C_{12}$–$C_{15}$ oxo alcohol condensed with 7 moles ethylene oxide and 1 part by weight sodium alkylbenzene sulphonate.

The bulk density of the powder thus obtained was 0.63 kg/l.

To this powder there was added a granulate of the following composition:

| | Parts by weight |
|---|---|
| Sodium perborate monohydrate | 8.58 |
| Sodium tripolyphosphate | 4.50 |
| Sodium sulphate | 5.252 |
| Zeolite, 80% | 4.00 |
| Monostearyl phosphate | 1.00 |
| $C_{12}$–$C_{15}$ oxo alcohol, condensed with 7 mol EO | 2.85 |

Thereafter the following components were added:

| | Parts by weight |
|---|---|
| Perfume | 0.254 |
| TAED granulate (65%) | 8.46 |
| Ethylenediaminetetramethylenephosphonic acid, Ca salt | 2.60 |
| Proteolytic enzyme granulate | 0.846 |

The finished powder had a bulk density of 0.70 kg/l. and an AD content of 10 parts by weight of nonionic surfactant and 6 parts by weight anionic surfactant.

When in this Example the sodium alkylbenzene sulphonate content of the base powder was increased by 2% and the nonionics content accordingly reduced by 2%, a finished powder having a bulk density of 0.68 kg/l. was obtained.

We claim:

1. A process for the preparation of a nonionic surfactant-containing powder detergent composition having a total surfactant content from 5 to 15% and of greater than 0.60 kg/l bulk density, comprising the steps of:

(a) spray-drying a base powder comprising from about 4% to about 6% by weight of said detergent composition of a nonionic surfactant;

(b) spraying onto said base powder a further amount of nonionic surfactant in an amount from about 4% up to not more than half of the total nonionic content by weight of said detergent composition;

(c) subsequent to step (b) adding a final amount of nonionic surfactant obtained by granulation with a carrier, the amounts of said surfactant and carrier being from about 2.85 to 4.0% and being about 22%, respectively, by weight of said detergent composition; and (d) subsequently adding adjunct detergent components to the base powder, said base powder being essentially free of sodium sulfate and the carrier for the nonionic surfactant comprising a mixture of zeolite and alkali metal perborate monohydrate in the amount of about 3 to 4% and about 8.5%, respectively, by weight of said detergent composition; said base powder and nonionic containing granulated carrier being present from about 59% and about 26%, respectively, by weight of said detergent composition.

2. A process according to claim 1, wherein the detergent composition comprises a mixture of nonionic and anionic surfactants in an amount from 5 to 15% and 3 to 12%, respectively, by weight of said composition.

3. A process according to claim 1, wherein the base powder contains about 5% zeolites.

4. A process according to claim 1, wherein the base powder contains less than one-half of the total quantity of nonionic surfactant and not more than one-half of the remaining portion of the total quantity of nonionic surfactant is sprayed onto the base powder.

5. A process according to claim 1, wherein about 1% of an anionic surfactant is sprayed onto the base powder together with about 4% of the nonionic surfactant in step (b).

* * * * *